United States Patent [19]

MacKay

[11] Patent Number: 4,934,137

[45] Date of Patent: Jun. 19, 1990

[54] TEMPERATURE MEASUREMENT IN TURBINE ENGINES

[75] Inventor: Charles G. MacKay, Scottsdale, Ariz.

[73] Assignee: Allied-Signal Inc., Morris Township, Morris County, N.J.

[21] Appl. No.: 284,214

[22] Filed: Dec. 14, 1988

[51] Int. Cl.[5] ..... F02C 7/00

[52] U.S. Cl. ..... 60/39.33; 60/39.83; 415/118; 374/125

[58] Field of Search ..... 60/39.33, 39.83; 415/118; 356/43, 44; 374/121, 125, 132

[56] References Cited

U.S. PATENT DOCUMENTS

| | | | |
|---|---|---|---|
| 2,472,497 | 10/1969 | Preszler . | |
| 2,687,611 | 8/1954 | Larsen . | |
| 3,584,509 | 6/1971 | Compton et al. . | |
| 3,623,368 | 11/1971 | Decker, Jr. . | |
| 3,696,678 | 10/1972 | Mossey . | |
| 4,037,473 | 7/1977 | Compton et al. . | |
| 4,306,835 | 12/1981 | Hurley | 356/43 |
| 4,411,533 | 10/1983 | Loftus et al. | 374/125 |
| 4,459,043 | 7/1984 | Luke . | |
| 4,582,426 | 4/1986 | Douglas | 374/121 |
| 4,650,328 | 3/1987 | Pointer et al. | 374/125 |
| 4,657,385 | 4/1987 | Pointer | 356/43 |
| 4,657,386 | 4/1987 | Gonzalez et al. | 356/43 |
| 4,786,188 | 11/1988 | Myhre et al. | 356/43 |
| 4,836,689 | 6/1989 | O'Brien et al. | 374/125 |

FOREIGN PATENT DOCUMENTS 683391 11/1952 United Kingdom .

*Primary Examiner*—Louis J. Casaregola

*Attorney, Agent, or Firm*—Joseph R. Black; James W. McFarland; Robert A. Walsh

[57] ABSTRACT

A turbine engine (10) having an optical pyrometer (38) for temperature measurement within the turbine (24) is disclosed. The shroud (64) of the turbine has a deflection surface (142) on the downstream side of an aperture (60) through which the pyrometer (38) images an area (56) in the turbine. The deflection surface (142) deflects into the flow path (26) of the combustion gas particulates which would otherwise enter a plenum (134). The imaging probe (52) of the pyrometer (38) is surrounded by a plenum (134) along its axial length to provide an air purging arrangement for the plenum (134) and the lens (66). Various geometrical relationships between the probe (52) and the shroud (64), and between the probe and the inner surface (98,136) of the plenum (134) are employed to minimize entry of particulates into the plenum and to provide an aerodynamically efficient purging system. Air tapped from a compressor (12) is used to cool the pyrometer (38) and supply the plenum (134).

27 Claims, 2 Drawing Sheets

FIG. 1
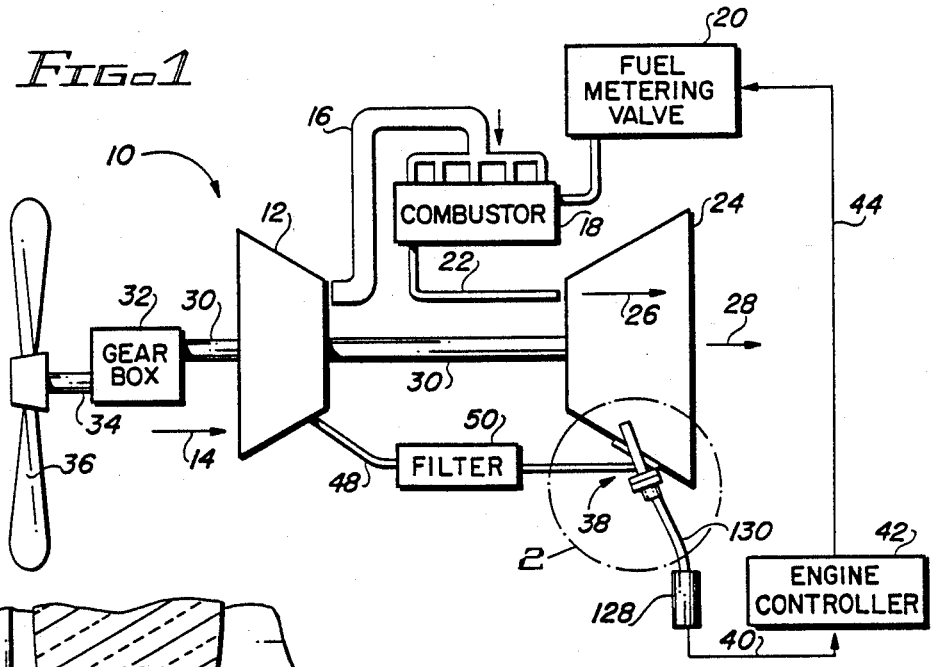
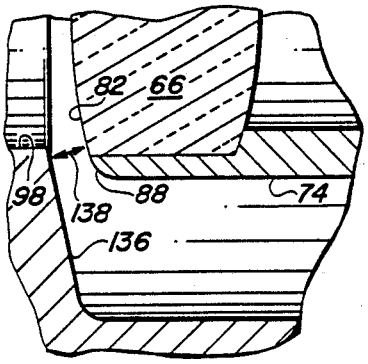
FIG. 5
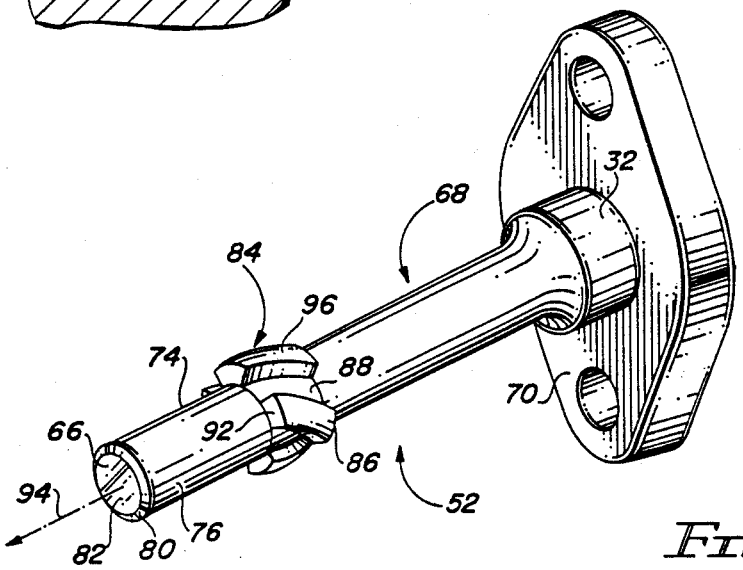
FIG. 2

TEMPERATURE MEASUREMENT IN TURBINE ENGINES

The United States Government has rights in the present invention pursuant to Contract No. N00019-83-C-0123 issued by the Department of the Navy.

TECHNICAL FIELD

The present invention relates generally to turbine engines and more particularly to temperature sensing apparatus employed in such engines to indicate temperature in an area of the turbine. Still more particularly, the invention pertains to turbine engines incorporating means designed to minimize or eliminate error in temperature sensing that results from contamination of the sensing apparatus by articulates which are present in the combustion gas flowing through the turbine.

BACKGROUND OF THE INVENTION

A general goal in turbine engine technology is to provide the ability to accurately measure temperature within the turbine in order to optimize engine performance and maximize engine life. Typically, temperature measurements are provided through the use of thermocouples. These devices have certain disadvantages including relatively high response times which can be lowered only at the expense of decreased longevity. These disadvantages have motivated attempts to develop practicable sensors based on optical pyrometry. However, problems of accuracy and of temperature-dependent drift in detector responses have severely limited the application of these sensors therefore turbine engines. For example, problems have been encountered in developing a calibration system that will enable such sensors to perform in accordance with expectations in the pertinent industries. More relevant to the present invention, however, are problems associated with the combustion products of turbine engines. Such engines produce carbon particles carried by combustion gases through the turbine. These particles contaminate the lens of the optical pyrometer and emit radiation, thus presenting sources of error in measurement. Accordingly, the sensors are typically provided with systems which supply air used to purge such particles from a channel through which turbine blades are imaged (See, e.g., U.S. Pat. Nos. 3,696,678 Mossey and 4,037,473 Compton et al.), the channel thus serving as both an imaging channel and an air plenum. However, while the need to incorporate a purging arrangement has been long recognized, prior approaches have indicated neither an awareness of the subtleties involved in providing an aerodynamically efficient purging arrangement, nor the desirability of minimizing entry of particulates into the imaging channel or plenum in the first instance. Also relevant to the present invention is the forementioned problem of temperature-dependent drift in detector responses. Prior teaching has been that detectors used in optical pyrometers are best positioned remotely from high-temperature areas of the engine in order to avoid or minimize this drift. Under such an arrangement, fiber-optic cables are typically employed to transfer radiation from the imaging probe to the detector. The use of engine fuel to cool the detectors has been suggested for arrangements in which the detectors are positioned in closer proximity to high-temperature areas. However, it has been discovered that substantial thermal stability can be achieved by cooling the detectors with air delivered from the compressor.

Accordingly, an objective of the present invention is to provide a turbine engine that comprises temperature measuring apparatus based on optical pyrometry, wherein the turbine shroud is adapted to minimize entry of particulates into a plenum along which a portion of the turbine is imaged.

Another objective of the invention is to provide a turbine engine that comprises a temperature measuring apparatus based on optical pyrometry, wherein the apparatus and the turbine shroud are adapted with respect to each other such that a sight aperture through which the apparatus images a portion of the turbine is minimized in cross-sectional area in order to minimize entry of particulates into said plenum.

A further objective of the invention is to provide a turbine engine that comprises a temperature measuring apparatus based on optical pyrometry, wherein the apparatus is designed to provide a highly efficient arrangement for maintaining a particulate-free imaging lens and for purging particulates from said plenum.

Another objective of the invention is to provide such engines wherein the detector of the pyrometer is kept sufficiently cool to avoid substantial drift in its response by supplying cooling air delivered from a compressor.

Advantages provided by the invention, in addition to such further objectives as are evidenced hereinafter, will be apparent from the following description which includes the appended claims and accompanying drawings.

SUMMARY OF THE INVENTION

This invention provides a turbine engine that comprises temperature measuring apparatus based on optical pyrometry. The apparatus comprises an imaging probe, an infrared radiation detector, and means for defining a plenum extending from a sight aperture formed in the turbine shroud to the imaging probe. Preferably, the plenum surrounds the imaging probe over an axially extending portion thereof including the imaging lens. In operation, air supplied from a compressor is filtered, delivered to the plenum, and discharged through the sight aperture in order to purge particulates from the plenum.

In accordance with one aspect of the invention, the probe is spaced from the sight aperture so that the nominal position of the forward focus of the lens is at the aperture. This enables the use of as small a sight aperture as is practicable in view of the optical geometry of the probe, and the area that is imaged thereby. The associated advantage is that the smaller one makes the sight aperture, the lower is the probability that a given particle will be propelled by the combustion gas into the plenum.

In accordance with a second aspect of the invention, the turbine shroud is chamfered, curved, or otherwise angled along a downstream portion of the rim of the sight aperture in order to provide a deflection surface, whereby particulates which would migrate into the plenum or be propelled therein by combustion gas are deflected back into the flow path of the combustion gas.

In accordance with a third aspect of the invention, the detector is positioned within the probe and the air supplied from the compressor is directed onto the probe at a position approximately corresponding to that of the detector in order to minimize temperature-dependent drifts in response.

Other aspects of the invention involve structural features of the probe itself, and of the plenum defining means in relation to the probe. By way of these structural features, known aerodynamic phenomena are employed to maintain a clean outer surface for the imaging lens while providing an efficient arrangement for purging particulates from the plenum. Although these aerodynamic phenomena are known as such, it is believed that they have not been applied to the problem of providing an efficient purging arrangement for an optical pyrometer as taught by the invention disclosed herein.

BRIEF DESCRIPTION OF THE DRAWINGS

FIG. 1 is a schematic illustration of a gas turbine engine incorporating the present invention.

FIG. 2 is a perspective view of the imaging probe illustrated in cross-section in FIG. 3.

FIG. 5 is an enlargement of the area indicated by the numeral 5 in FIG. 3.

DESCRIPTION OF THE PREFERRED EMBODIMENT

Figure 3:
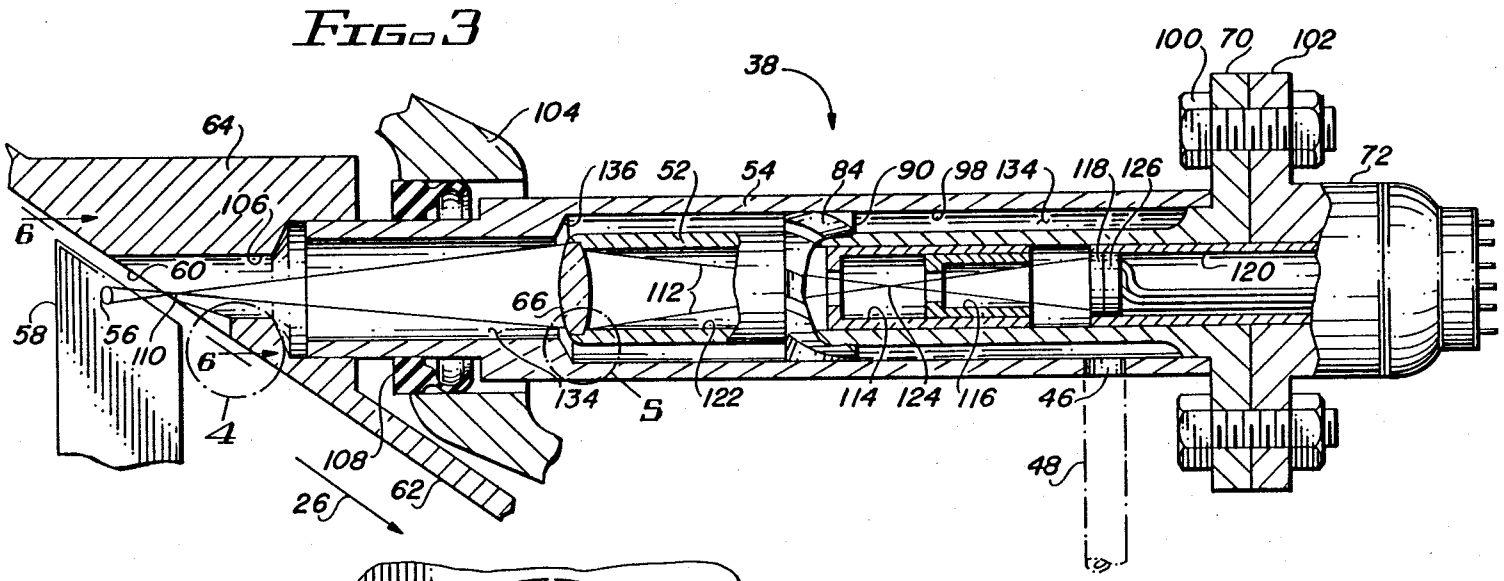
FIG. 3 is a generally cross-sectional, partially schematic view of the temperature sensing apparatus and certain portions of the turbine indicated in FIG. 1.
Figure 4:
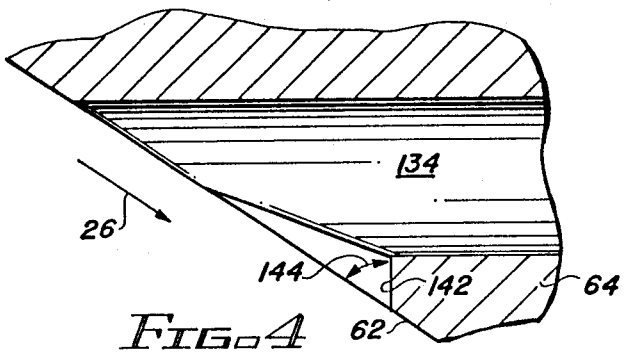
FIG. 4 is an enlargement of the area indicated by the numeral 4 in FIG. 3.

FIG. 1 schematically depicts a turbine engine 10 in which a compressor 12 compresses air 14 inducted into an air intake shroud (not shown). The compressed air is delivered along a flow path 16 to a combustor 18. Within the combustor 18, the compressed air is mixed with fuel delivered via a metering valve 20 and the mixture is burned to produce high-pressure combustion gas. The combustion gas is delivered along a flow path 22 to a turbine 24 which typically includes a plurality of turbine stages. The combustion gas moves through the turbine 24 along a flow path 26 and is expanded to ambient pressure and discharged, as indicated by the arrow numbered 28. Force applied by the combustion gas on the rotor vanes (not shown) of the turbine 24 causes rotation of a central shaft 30. The central shaft 30 drives the compressor 12 and, via a gear train 32 and shaft 34, drives a fan or propeller 36.

The engine 10 incorporates apparatus 38 for sensing temperature in the turbine 24 in order to provide electrical signals 40 to a gauge which is monitored by a pilot, and to an engine controller 42. The controller 42 typically employs numerical representations of the signals 40 in a control algorithm from which control signals 44 are produced and communicated to the metering valve 20, which regulates fuel flow to the combustor 12. The apparatus 38 has an air inlet 46 (FIG. 3) to which purging air is supplied. The purging air is bled from the compressor 12 and delivered to the inlet 46 along a supply line 48 after passing through a 2-micron filter 50 which removes particulates.

FIG. 3 illustrates the temperature sensing apparatus 38 of FIG. 1 in more detail. A generally cylindrical imaging probe 52 surrounded by a generally tubular member 54 is positioned to image a small area 56 centered near the midspan of the rotor blades (as at 58). The small area 56 is imaged through a sight aperture 60 formed at the radially inward-facing surface 62 of the turbine shroud 64.

Referring now to FIG. 2, the imaging probe 52 defines at a forward end a biconvex sapphire lens 66 that is sealed by a suitable adhesive to a hollow metal tube 68. The probe 52 has a flange 70 at its rearward end that is used for securement to a housing 72 (FIG. 3). A first axially extending portion 74 of the probe 52 has a circular-cylindrical exterior surface 76. A second portion 78 (FIG. 5) near the forward end of the probe 52 has a curved exterior surface 80 that radially converges from the exterior surface 76 of the first portion 74 to the outer surface 82 of the lens 66 so that the surfaces are substantially continuous. An air-swirl component 84 is secured to the probe 52 or formed integrally therewith at a position which is rearward from the first portion 74. The swirl component 84 defines an alternating series of merlons (as at 86) and crenels (as at 88) extending circumferentially around the probe 52. The merlons 86 extend from a rearward-facing surface 90 (FIG. 3) of the component 84 to a forward-facing surface 92, and are angled at about twenty-five degrees with respect to the axis 94 of the probe 52. The radially-outward surfaces (as at 96) of the merlons 86 are curved to conform to the radially-inward surface 98 of the tubular member 54 (FIG. 3), the latter being coaxial with the probe 52.

Referring again to FIG. 3, the probe 52 is secured at its rearward end to the housing 72 via bolts 100 extending through flanges 70,102. The tubular member 54 extends beyond the forward end of the probe 52 through the turbine case 104, and is received at one end in a stepped bore 106 formed in the turbine shroud 64. A seal 108 is provided between the turbine case 104 and the tubular member 54 to prevent compressor delivery air from flowing through the turbine case and leaking through the turbine shroud 64 into the flow path 26 of the combustion gas. The turbine shroud 64 radially confines the combustion gas as it flows along the flow path 26 through the turbine 24 (FIG. 1). The stepped bore 106 forms the sight aperture 60 at the inner surface 62. The axis 94 (FIG. 2) of the probe 52 may be angled with respect to the inward-facing surface 62 as needed to provide the desired view into the turbine 24 while avoiding interference with other components of the engine 10 (FIG. 1). The lens 66 faces the sight aperture 60 and is spaced therefrom so that the nominal position of its forward focus 110 is at the aperture. This ensures the smallest aperture size possible in view of the optical geometry of the probe 52 and the size of the area 56 imaged thereby. The probe 52 defines a radiation path 112 extending axially therethrough. In traversing the radiation path 112, radiation enters through the lens 66, passes through holes formed in two glare stops 114,116, and impinges an infrared radiation detector 118 secured within a hollow cylindrical portion 120 of the housing 72. The detector 118 is selected or adapted to respond to radiation ranging from about 0.5 microns to about 2.1 microns in wavelength. The glare stops 114,116 are brazed to the inner surface 122 of the metal tube 68 and positioned such that their respective holes are equidistant from the rearward focus 124 of the lens 66. The detector 118 and a thermistor 126 form the data acquisition portion of a data acquisition and processing system, which may be of any conventional type. However, it is preferred to provide suitable preamplification and temperature compensation circuitry in the housing 72 and to position the main amplification and signal conditioning circuitry in a remote second housing 128 (FIG. 1). Communication is provided by a cable 130 (FIG. 1) connected between the two housings 72,128.

As shown, the probe 52 is surrounded by the tubular member 54, and is radially spaced therefrom except at the radially-outward surfaces 96 of the merlons 86 and at the surface of a rearwardly-disposed land 132 (FIG. 2). The tubular member 54 defines part of a plenum 134 that surrounds the first axially-extending portion 74, the second portion 78, and the lens 66. The tubular member 54 further defines an inlet 46 to the plenum 134. The plenum 134 extends from the inlet 46 to the sight aperture 60. The inlet 46 is positioned to direct air onto the probe 52 at an axial position thereof which nominally corresponds to that of the detector 118. This provides a cooling effect in order to minimize temperature-dependent drift in the response of the detector 118. Tests have shown that the detector location can be cooled to well below the maximum safe operating temperature of the detector 118 when using only a single air injection site. Even better results should be obtainable by increasing the thickness of the tubular member 54 over an axial range which straddles the detector 118 so that a staging plenum can be provided which receives air from the supply line 48 and is in fluid communication with the main plenum 134 via a plurality of holes extending circumferentially around the detector. Air entering the plenum 134 from the inlet 46 is constrained to flow in a downstream direction through the crenels 88 (FIG. 2), along the first and second portions 74,78 of the probe 52, past the lens 66, and through the aperture 60.

Considering the inner surface 98 of the tubular member 54, and referring now to FIGS. 3 and 5, it will be observed that the member has a larger inside diameter along an axially extending portion upstream from the outer surface 82 of the lens 66, and a smaller inside diameter along an axially extending portion downstream from the outer surface. The inner surface 98 of the tubular member 54 converges from the larger-diameter portion to the smaller-diameter portion to form a flow ramp 136, thus defining a gap distance 138 between the ramp and the outer surface 82 of the lens 66. Preferably, the flow ramp 136 is approximately parallel the outer surface 82 as determined at the point nearest the flow ramp. In any case, the flow ramp 136 should form an angle with respect to the outer surface 82 that is no greater than ten degrees. At greater angles, air flowing through the gap 138 tends to follow the inner surface 98 of the tubular member 54 rather than sweeping the outer surface 82 of the lens 66.

Referring now to FIGS. 2, 3, and 5, the tubular member 54 is dimensioned in relation to the probe 52, and the probe is positioned in relation to the flow ramp 136 such that the ratio of the outside diameter defined by the exterior surface 76 to the distance defined by the gap 138 is less than or equal to twenty-four. Preferably, this ratio is about nine. This prevents separation of air from the lens 66 at too great a distance from the center of the outer surface 82, thus ensuring that substantially the entire outer surface of the lens 66 is wiped by the air.

It will be observed also that the plenum 134 is annular in cross-section where it surrounds the first axially extending portion 74 of the probe 52, and conical in cross section at the gap 138. The ratio of the associated cross-sectional flow areas is important in providing an effective air curtain adjacent the outer surface 82, and in keeping the size of the entire apparatus 38 within dimensions which are practicable for turbine engines. This ratio (conical/annular areas) should be in the range of from 0.310 to 0.440 for a flow ramp 136 which is angled at about 79° in relation to the axis 94 and is substantially parallel to the outer surface 82 of the lens 66. In the general case, the ratio should be about 0.028–0.040 times the difference between ninety and the surface angle of the lens 66 at the point closest to the flow ramp 136.

The curved exterior surface 80 of the second portion 78 of the probe 52 should have a radius of curvature greater than or equal to one-tenth the distance defined by the gap 138. This ensures that the air follows the exterior surface of the probe 52 in passing through the gap 138, which assists in providing effective wiping action along the outer surface 82.

Figure 6:
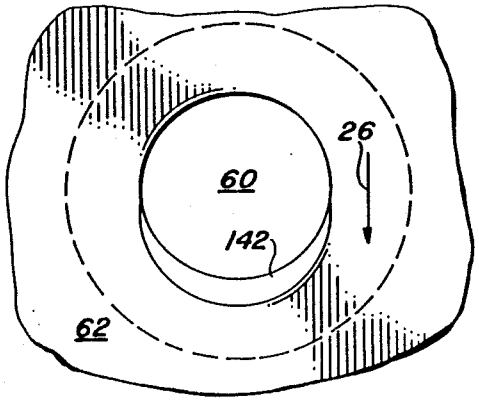
FIG. 6 is an elevational view of the sight aperture and inner surface of the turbine shroud as seen along lines 6—6 of FIG. 3.

Referring now to FIG. 6, entry of particulates into the plenum 134 is further minimized by beveling or rounding the rim of the inward-facing surface 62 of the shroud 64 where it surrounds the sight aperture 60, along a portion thereof which is downstream in relation to the flow path 26 of the combustion gas. Accordingly, the radially inward-facing surface 62 of the shroud 64 defines a deflection surface 142 from which particulates that would otherwise migrate into the plenum 134 or be propelled therein by the combustion gas are deflected back into the flow path 26. The angle 144 (or mean angle in the case of a curve) between the deflection surface 142 and the main portion of the inner surface 62 of the shroud 64 is about forty degrees, and should in any case be in the range extending from twenty-five to forty-five degrees.

Referring again to FIGS. 2 and 3, the swirl component 84 redirects air along the plenum 134 to produce a swirling flow as the air sweeps through the gap 138. This is believed to increase the cross-sectional flow area at the expected vena contracta downstream from the flow ramp 136. This in turn should minimize recirculation of air in the plenum 134. It is anticipated that the angle at which the air is redirected (i.e. the angle of the path defined by the crenels 88 with respect to the axis 94) can in general not exceed thirty degrees without encountering separation problems at the outer surface 82 of the lens 66. The optimal angle is believed to depend upon such factors as the radius of curvature of the second portion 78, the angle of the flow ramp 136 with respect to the outer surface 82, and the flow rate.

Having described the preferred embodiment, it will be understood that the invention provides the following unique features, each of which contributes, or is believed to contribute, to improving the precision of temperature measuring apparatus employed in turbine engines.

First, by arranging the imaging probe such that the forward focus of its lens is at the sight aperture, entry of particulates into the plenum can be minimized by providing as small a sight aperture as is practicable in view of the optical geometry of the probe, the area imaged thereby, and the response characteristics of the detector.

Second, by beveling or rounding the sight aperture to provide a deflection surface, particulates that would otherwise be propelled by the combustion gas into the plenum are instead deflected back into the flow path of the combustion gas, thereby further minimizing entry of particulates into the plenum.

Third, by providing a curved exterior surface near the forward end of the probe, the purging air tends to follow the surface of the probe and sweep across the outer surface of the lens rather than separate from the probe at its forward end.

Fourth, by providing plenum-defining means that defines a flow ramp approximately parallel to the outer surface of the lens, the air sweeping through the gap is directed along the outer surface at high speed to provide an effective wiping action, and is prevented from following the inner surface of the tubular member in preference to the outer surface of the lens.

Fifth, by dimensioning the tubular member in relation to the probe such that the ratio of the air flow cross-section defined by the gap to that defined by the annular portion of the plenum is in the above-described range, an effective air shield can be provided adjacent the lens while keeping the distance between the exterior surface of the probe and the inner surface of the tubular member within practicable dimensions.

Sixth, by dimensioning and positioning the tubular member in relation to the probe such that the ratio of the diameter of the probe to the gap distance is less than twenty-four, air sweeping through the gap and across the outer surface of the lens will traverse a substantial portion of the radial distance of the outer surface prior to separation therefrom, thus providing more complete wiping action.

Seventh, redirecting the air to produce a swirling flow as the air sweeps through the gap is believed to impede the formation of a centrally converging jet within that portion of the plenum between the lens and the aperture. Such centrally converging flow would create pockets of relatively stagnant air in which particulates could accumulate.

Finally, by directing air tapped from the compressor onto the probe at a position nominally corresponding to that of the detector, temperature-dependent drift in the response of the detector is minimized.

It should be understood that the description herein is that of the preferred embodiment of the invention. This description is intended as illustrative rather than restrictive. Accordingly, the invention should be construed in the broadest manner consistent with the following claims and their equivalents.

What is claimed is:

1. A turbine engine having a compressor adapted to compress air inducted into said engine, a combustor adapted to burn a mixture of fuel and compressed air to produce combustion gas, a turbine adapted to produce rotary motion in response to pressure exerted by said combustion gas as it moves downstream along a flow path defined in part by a radially inward-facing surface of a turbine shroud, said turbine being drivingly engaged via a shaft with said compressor to impart said rotary motion thereto, and apparatus for monitoring temperature in said turbine, wherein said apparatus comprises:

a generally cylindrical imaging probe defining a radiation path extending axially therethrough, said probe having at one end a lens defining a forward focus, said lens having a convex outer surface, said outer surface facing and being spaced from an aperture formed in said turbine shroud so that said forward focus is positioned approximately at said aperture, said probe being secured and positioned in said engine to image an area of a component of said turbine through said aperture;

a radiation detector for producing electrical indications of the intensity of infrared radiation traversing said radiation path, said detector being positioned with respect to said radiation path such that an image of said area is formed thereon: and means for defining a plenum surrounding at least an axially extending portion of said probe including said lens, said plenum extending in a downstream direction from an inlet thereto to said aperture, wherein said inlet is positioned upstream from said lens so that air entering said plenum via said inlet is constrained to flow along said axially extending portion, past said lens, and through said aperture.

2. A turbine engine as in claim 1 wherein said turbine shroud is beveled or rounded along a downstream portion of a rim surrounding said aperture to provide a deflection surface whereby particulates which would otherwise migrate into said plenum or be propelled therein by said combustion gas are deflected back into said flow path.

3. A turbine engine as in claim 2 wherein said defining means has an inner surface defining first and second portions thereof, said defining means having larger and smaller inside diameters over said first and second portions, respectively, said larger-diameter portion being upstream from said outer surface of said lens, said smaller-diameter portion being downstream from said outer surface, said inner surface converging at an angle from said larger-diameter portion to said smaller-diameter portion to form a flow ramp, said flow ramp cooperating with said outer surface to define a gap distance therebetween.

4. A turbine engine as in claim 3 wherein said probe has a cylindrical exterior surface over said axially extending portion, said cylindrical surface defining a diameter that is less than twenty-four times said gap distance.

5. A turbine engine as in claim 4 wherein said probe has a curved exterior surface between said cylindrical surface and said one end, and said curved exterior surface converging, in a radially inward direction in relation to said probe, from said cylindrical surface to said one end.

6. A turbine engine as in claim 5 wherein the radius of curvature of said curved exterior surface is at least one-tenth said gap distance.

7. A turbine engine having a compressor adapted to compress air inducted into said engine, a combustor adapted to burn a mixture of fuel and compressed air to produce combustion gas, a turbine adapted to produce rotary motion in response to pressure exerted by said combustion gas as it moves downstream along a flow path defined in part by a radially inward-facing surface of a turbine shroud, said turbine being drivingly engaged via a shaft with said compressor to impart said rotary motion thereto, and apparatus for monitoring temperature in said turbine, wherein said apparatus comprises:

a generally cylindrical imaging probe defining a radiation path extending axially therethrough, said probe having at one end a lens defining a forward focus, said lens having a convex outer surface, said outer surface facing and being spaced from an aperture formed in said turbine shroud so that said forward focus is positioned approximately at said aperture, said probe being secured and positioned in said engine to image an area of a component of said turbine through said aperture, said aperture being surrounded by a rim which is beveled or rounded along a downstream portion thereof to provide a deflection surface whereby particulates which would otherwise migrate into said plenum or be propelled therein by said combustion gas are deflected back into said flow path;

a radiation detector for producing electrical indications of the intensity of infrared radiation traversing said radiation path, said detector being positioned with respect to said radiation path such that an image of said area is formed thereon; and means for defining a plenum surrounding at least an axially extending portion of said probe including said lens, said plenum extending in a downstream direction from an inlet thereto to said aperture, wherein said inlet is positioned upstream from said lens so that air entering said plenum via said inlet is constrained to flow along said axially extending portion, past said lens, and through said aperture, said defining means having an inner surface defining first and second portions thereof, said defining means having larger and smaller inside diameters over said first and second portions, respectively, said larger-diameter portion being upstream from said outer surface of said lens, said smaller-diameter portion being downstream from said outer surface, said inner surface converging at an angle from said larger-diameter portion to said smaller-diameter portion to form a flow ramp, said flow ramp cooperating with said outer surface to define a gap distance therebetween, said flow ramp being substantially parallel to said outer surface.

8. A turbine engine having a compressor adapted to compress air inducted into said engine, a combustor adapted to burn a mixture of fuel and compressed air to produce combustion gas, a turbine adapted to produce rotary motion in response to pressure exerted by said combustion gas as it moves downstream along a flow path defined in part by a radially inward-facing surface of a turbine shroud, said turbine being drivingly engaged via a shaft with said compressor to impart said rotary motion thereto, and apparatus for monitoring temperature in said turbine, wherein said apparatus comprises:

a generally cylindrical imaging probe defining a radiation path extending axially therethrough, said probe having at one end a lens defining a forward focus, said lens having a convex outer surface, said outer surface facing and being spaced from an aperture formed in said turbine shroud so that said forward focus is positioned approximately at said aperture, said probe being secured and positioned in said engine to image an area of a component of said turbine through said aperture, said aperture being surrounded by a rim which is beveled or rounded along a downstream portion thereof to provide a deflection surface whereby particulates which would otherwise migrate into said plenum or be propelled therein by said combustion gas are deflected back into said flow path;

a radiation detector for producing electrical indications of the intensity of infrared radiation traversing said radiation path, said detector being positioned with respect to said radiation path such that an image of said area is formed thereon; and means for defining a plenum surrounding at least an axially extending portion of said probe including said lens, said plenum extending in a downstream direction from an inlet thereto to said aperture, wherein said inlet is positioned upstream from said lens so that air entering said plenum via said inlet is constrained to flow along said axially extending portion, past said lens, and through said aperture, said defining means having an inner surface defining first and second portions thereof, said defining means having larger and smaller inside diameters over said first and second portions, respectively, said larger-diameter portion being upstream from said outer surface of said lens, said smaller-diameter portion being downstream from said outer surface, said inner surface converging at an angle from said larger-diameter portion to said smaller-diameter portion to form a flow ramp, said flow ramp cooperating with said outer surface to define a gap distance therebetween, said flow ramp being substantially parallel to said outer surface of said lens, said probe having a cylindrical exterior surface over said axially extending portion, said cylindrical surface defining a diameter that is less than twenty-four times said gap distance, said probe having a curved exterior surface between said cylindrical surface and said one end, said curved exterior surface converging in a radially inward direction in relation to said probe from said cylindrical surface to said one end, said curved exterior surface having a radius of curvature that is at least one-tenth said gap distance.

9. A turbine engine as in claim 8 further comprising means, secured to or integral with said probe, being surrounded by said defining means, and being positioned downstream from said inlet and immediately upstream from said axially extending portion of said probe, for redirecting air flowing along said plenum to produce a spiral flow thereof.

10. A turbine engine as in claim 9 wherein said redirecting means defines an alternating series of merlons and crenels extending circumferentially around said probe, said merlons abutting said inner surface of said defining means and said crenels being angled in relation to the longitudinal axis of said probe.

11. A turbine engine as in claim 10 wherein the angle of said crenels with respect to said axis of said probe is in the range of from five to thirty degrees.

12. A turbine engine having a compressor adapted to compress air inducted into said engine, a combustor adapted to burn a mixture of fuel and compressed air to produce combustion gas, a turbine adapted to produce rotary motion in response to pressure exerted by said combustion gas as it moves downstream along a flow path defined in part by a radially inward-facing surface of a turbine shroud, said turbine being drivingly engaged via a shaft with said compressor to impart said rotary motion thereto, and apparatus for monitoring temperature in said turbine, wherein said apparatus comprises:

a generally cylindrical imaging probe defining a radiation path extending axially therethrough, said probe having at one end a lens defining a forward focus, said lens having a convex outer surface, said outer surface facing and being spaced from an aperture formed in said turbine shroud so that said forward focus is positioned approximately at said aperture, said probe being secured and positioned in said engine to image an area of a component of said turbine through said aperture;

a radiation detector positioned within said probe for producing electrical indications of the intensity of infrared radiation traversing said radiation path, said detector being positioned with respect to said radiation path such that an image of said area is formed thereon; and means for defining a plenum surrounding at least an axially extending portion of said probe including said lens, said plenum extending in a downstream direction from an inlet thereto to said aperture, wherein said inlet is positioned upstream from said lens so that air entering said plenum via said inlet is constrained to flow along said axially extending portion, past said lens, and through said aperture, said inlet being positioned to direct air onto said probe at an axial position thereof which nominally corresponds to that of said detector.

13. A turbine engine as in claim 12 wherein said turbine shroud is beveled or rounded along a downstream portion of a rim surrounding said aperture to provide a deflection surface, whereby particulates which would otherwise migrate into said plenum or be propelled therein by said combustion gas are deflected back into said flow path.

14. A turbine engine as in claim 13 wherein said axially extending portion of said probe has a cylindrical exterior surface, and a curved exterior surface between said cylindrical surface and said outer surface of said lens, and wherein said curved exterior surface converges in a radially inward direction from said cylindrical surface to said outer surface.

15. A turbine engine as in claim 14 wherein said defining means has an inner surface defining first and second axially extending portions thereof, said defining means having larger and smaller inside diameters over said first and second portions, respectively, said larger-diameter portion being generally upstream from said outer surface of said lens and said smaller-diameter portion being generally downstream from said outer surface, said inner surface converging from said larger-diameter portion to said smaller-diameter portion to form a flow ramp, said flow ramp cooperating with said outer surface to define a gap distance therebetween.

16. A turbine engine as in claim 15 wherein said cylindrical surface defines an outside diameter of said probe and said outside diameter is less than twenty-four times said gap distance.

17. A turbine engine as in claim 16 wherein said flow ramp is substantially parallel to said outer surface of said lens.

18. A turbine engine having a compressor adapted to compress air inducted into said engine, a combustor adapted to burn a mixture of fuel and compressed air to produce combustion gas, a turbine adapted to produce rotary motion in response to pressure exerted by said combustion gas as it moves downstream along a flow path defined in part by a radially inward-facing surface of a turbine shroud, said radially inward-facing surface defining a sight aperture and a rim surrounding said sight aperture, said turbine being drivingly engaged with said compressor to impart said rotary motion thereto, and apparatus for monitoring temperature in said turbine, wherein said apparatus comprises:

an imaging probe defining a radiation path extending axially therethrough, said probe having an axially extending exterior surface leading to a forward end of said probe, said forward end having a lens with a convex outer surface, said outer surface facing said sight aperture whereby said probe images an area of a component of said turbine through said sight aperture, said lens defining a forward focus and being spaced from said sight aperture whereby said focus is positioned approximately at said aperture;

a radiation detector for producing electrical signals indicative of the intensity of infrared radiation traversing said radiation path, said detector being positioned in relation to said radiation path whereby an image of said area is formed on said detector; and means for defining a plenum between said lens and said sight aperture and an inlet to said plenum whereby air which enters said plenum through said inlet is constrained to flow along said plenum and through said sight aperture.

19. A turbine engine as in claim 18 wherein said plenum defining means surrounds at least a portion of said axially extending surface of said probe and wherein said inlet is positioned such that air entering said plenum therefrom is constrained to flow along said portion, past said lens, and through said sight aperture.

20. A turbine engine as in claim 19 wherein said plenum defining means has an inner surface defining first and second portions thereof, said defining means having larger and smaller inside diameters over said first and second portions, respectively, said larger-diameter portion being generally upstream from said outer surface of said lens and said smaller-diameter portion being generally downstream from said outer surface, said inner surface converging from said larger-diameter portion to said smaller-diameter portion to form a flow ramp, said flow ramp cooperating with said outer surface to define a gap distance therebetween.

21. A turbine engine as in claim 20 wherein said portion of said exterior surface of said probe has a cylindrical surface defining an outside diameter, the ratio of said outside diameter to said gap distance being less than twenty-four.

22. A turbine engine as in claim 21 wherein said portion of said exterior surface of said probe has a curved surface positioned between said cylindrical surface and said outer surface of said lens, said curved surface converging in a radially inward direction from said cylindrical surface to said outer surface.

23. A turbine engine as in claim 18 wherein said lens defines a forward focus and said probe is positioned in relation to said sight aperture such that said forward focus has substantially the same position along an axis defined by said probe as does said sight aperture.

24. A turbine engine having a compressor adapted to compress air inducted into said engine, a combustor adapted to burn a mixture of fuel and compressed air to produce combustion gas, a turbine adapted to produce rotary motion in response to pressure exerted by said combustion gas as it moves downstream along a flow path defined in part by a radially inward-facing surface of a turbine shroud, said radially inward-facing surface defining a sight aperture, said turbine being drivingly engaged with said compressor to impart said rotary motion thereto, and apparatus for monitoring temperature in said turbine, wherein said apparatus comprises:

an imaging probe defining a radiation path extending axially therethrough, said probe having an axially extending exterior surface leading to a forward end of said probe, said forward end having a lens with a convex outer surface, said outer surface facing said sight aperture whereby said probe images an area of a component of said turbine through said sight aperture;

a radiation detector for producing electrical signals indicative of the intensity of infrared radiation traversing said radiation path, said detector being positioned in relation to said radiation path whereby an image of said area is formed on said detector; and means for defining a plenum between said lens and said sight aperture and an inlet to said plenum whereby air which enters said plenum through said inlet is constrained to flow along said plenum and through said sight aperture, said plenum-defining means surrounding at least an axially extending portion of said axially extending surface of said probe, said inlet being positioned such that air entering said plenum therefrom is constrained to flow along said axially extending portion, past said lens, and through said sight aperture, said plenum-defining means having an inner surface defining first and second portions thereof, said defining means having larger and smaller inside diameters over said first and second portions, respectively, said larger-diameter portion being generally upstream from said outer surface of said lens and said smaller-diameter portion being generally downstream from said outer surface, said inner surface converging from said larger-diameter portion to said smaller-diameter portion to form a flow ramp, said flow ramp cooperating with said outer surface to define a gap distance therebetween, said flow ramp being substantially parallel to said outer surface.

25. A turbine engine having a compressor adapted to compress air inducted into said engine, a combustor adapted to burn a mixture of fuel and compressed air to produce combustion gas, a turbine adapted to produce rotary motion in response to pressure exerted by said combustion gas as it moves downstream along a flow path defined in part by a radially inward-facing surface of a turbine shroud, said radially inward-facing surface defining a sight aperture, said turbine being drivingly engaged with said compressor to impart said rotary motion thereto, and apparatus for monitoring temperature in said turbine, wherein said apparatus comprises:

an imaging probe defining a radiation path extending axially therethrough, said probe having an axially extending exterior surface leading to a forward end of said probe, said forward end having a lens with a convex outer surface, said outer surface facing said sight aperture whereby said probe images an area of a component of said turbine through said sight aperture;

a radiation detector for producing electrical signals indicative of the intensity of infrared radiation traversing said radiation path, said detector being positioned in relation to said radiation path whereby an image of said area is formed on said detector; and means for defining a plenum between said lens and said sight aperture and an inlet to said plenum, said plenum-defining means surrounding at least an axially extending portion of said axially extending surface of said probe, said inlet being positioned such that air entering said plenum therefrom is constrained to flow along said axially extending portion, past said lens, and through said sight aperture, said plenum-defining means having an inner surface defining first and second portions thereof, said defining means having larger and smaller inside diameters over said first and second portions, respectively, said larger-diameter portion being generally upstream from said outer surface of said lens and said smaller-diameter portion being generally downstream from said outer surface, said inner surface converging from said larger-diameter portion to said smaller-diameter portion to form a flow ramp, said flow ramp cooperating with said outer surface to define a gap distance therebetween, said probe cooperating with said larger-diameter portion of said inner surface and with said flow ramp to define first and second cross-sectional areas respectively, of said plenum, the ratio of said second cross-sectional area to said first cross-sectional area being within a range of from 0.028 times "X" to 0.040 times "X"; where "X" equals ninety minus a surface angle of said outer surface, said surface angle being determined where said outer surface is closest to said flow ramp.

26. A turbine engine having a compressor adapted to compress air inducted into said engine, a combustor adapted to burn a mixture of fuel and compressed air to produce combustion gas, a turbine adapted to produce rotary motion in response to pressure exerted by said combustion gas as it moves downstream along a flow path defined in part by a radially inward-facing surface of a turbine shroud, said radially inward-facing surface defining a sight aperture, said turbine being drivingly engaged with said compressor to impart said rotary motion thereto, and apparatus for monitoring temperature in said turbine, wherein said apparatus comprises:

an imaging probe defining a radiation path extending axially therethrough, said probe having an axially extending exterior surface leading to a forward end of said probe, said forward end having a lens with a convex outer surface, said outer surface facing said sight aperture whereby said probe images an area of a component of said turbine through said sight aperture, said lens defining a forward focus and said probe being positioned in relation to said sight aperture such that said forward focus has substantially the same position along an axis defined by said probe as does said sight aperture, said exterior surface of said probe having a portion near said lens that converges in a radially inward direction so that said outer surface and said portion form a substantially continuous surface;

a radiation detector for producing electrical signals indicative of the intensity of infrared radiation traversing said radiation path, said detector being positioned in relation to said radiation path whereby an image of said area is formed on said detector; and means for defining a plenum between said lens and said sight aperture and an inlet to said plenum whereby air which enters said plenum through said inlet is constrained to flow along said plenum and through said sight aperture.

27. A turbine engine having a compressor adapted to compress air inducted into said engine, a combustor adapted to burn a mixture of fuel and compressed air to produce combustion gas, a turbine adapted to produce rotary motion in response to pressure exerted by said combustion gas as it moves downstream along a flow path defined in part by a radially inward-facing surface of a turbine shroud, said radially inward-facing surface defining a sight aperture, said turbine being drivingly engaged with said compressor to impart said rotary motion thereto, and apparatus for monitoring temperature in said turbine, wherein said apparatus comprises:

an imaging probe defining a radiation path extending axially therethrough, said probe having an axially extending exterior surface leading to a forward end of said probe, said forward end having a lens with a convex outer surface, said outer surface facing said sight aperture whereby said probe images an area of a component of said turbine through said sight aperture;

a radiation detector for producing electrical signals indicative of the intensity of infrared radiation traversing said radiation path, said detector being positioned in relation to said radiation path whereby an image of said area is formed on said detector; and means for defining a plenum between said lens and said sight aperture and an inlet to said plenum, said plenum-defining means surrounding at least an axially extending portion of said axially extending surface of said probe, said inlet being positioned such that air entering said plenum therefrom is constrained to flow along said axially extending portion, past said lens, and through said sight aperture, said detector being positioned within said probe and said inlet being positioned such that air passing through said inlet into said plenum is directed onto said probe at an axial position thereof which nominally corresponds to that of said detector.

* * * * *

UNITED STATES PATENT AND TRADEMARK OFFICE

CERTIFICATE OF CORRECTION

PATENT NO. : 4,934,137

DATED : June 19, 1990

INVENTOR(S) : Charles G. Mackay

It is certified that error appears in the above-identified patent and that said Letters Patent is hereby corrected as shown below:

In column 1, line 34, "therefore" should be replaced with -- in --.

Signed and Sealed this

Eighth Day of October, 1991

*Attest:*

HARRY F. MANBECK, JR.

*Attesting Officer*

*Commissioner of Patents and Trademarks*